US007604258B2

(12) United States Patent
Getto et al.

(10) Patent No.: US 7,604,258 B2
(45) Date of Patent: Oct. 20, 2009

(54) HEAT EXCHANGER SUITABLE FOR VEHICLES

(75) Inventors: Oliver Getto, Stuttgart (DE); Alexander Schaudt, Tuttlingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 783 days.

(21) Appl. No.: 11/152,852

(22) Filed: Jun. 15, 2005

(65) Prior Publication Data

US 2006/0006642 A1 Jan. 12, 2006

(30) Foreign Application Priority Data

Jun. 15, 2004 (DE) ..... 10 2004 028 655

(51) Int. Cl.
*F16L 39/00* (2006.01)

(52) U.S. Cl. ..... 285/124.2; 285/124.3; 285/137.11; 285/189; 285/921

(58) Field of Classification Search ..... 285/68, 285/69, 78, 124.1, 124.3, 124.4, 137.11, 285/141.1, 142.1, 189, 423, 921
See application file for complete search history.

(56) References Cited

U.S. PATENT DOCUMENTS 1,139,748 A * 5/1915 Beatty ..... 174/157
2,510,125 A * 6/1950 Meakin ..... 174/47
3,125,359 A * 3/1964 Charles ..... 285/62
3,162,412 A * 12/1964 McEntire ..... 248/56
3,650,548 A * 3/1972 Hussauf ..... 285/3
3,869,153 A * 3/1975 De Vincent et al. ..... 285/124.3
3,937,498 A * 2/1976 Weinhold ..... 285/243
4,076,279 A * 2/1978 Klotz et al. ..... 285/26
4,105,046 A * 8/1978 Sturgis ..... 137/594
4,247,133 A * 1/1981 Moller ..... 285/4
4,602,658 A * 7/1986 Luther et al. ..... 137/614
4,753,268 A * 6/1988 Palau ..... 137/595
4,768,587 A 9/1988 Halder
4,900,065 A * 2/1990 Houck ..... 285/73
4,938,509 A * 7/1990 LaPlante ..... 285/26
4,982,736 A * 1/1991 Schneider ..... 607/104
4,999,885 A * 3/1991 Lee ..... 24/586.1
5,022,461 A * 6/1991 Potier et al. ..... 165/76
5,071,172 A * 12/1991 Gross ..... 285/124.4
5,098,047 A * 3/1992 Plumley ..... 248/68.1
5,170,841 A * 12/1992 Briet ..... 165/76
5,201,552 A * 4/1993 Hohmann et al. ..... 285/124.4
5,205,520 A * 4/1993 Walker ..... 248/74.1

(Continued)

FOREIGN PATENT DOCUMENTS

DE 35 17 488 A1 11/1986

(Continued)

*Primary Examiner*—James M Hewitt
*Assistant Examiner*—Jay R Ripley
(74) *Attorney, Agent, or Firm*—Foley & Lardner LLP

(57) ABSTRACT

A heat exchanger, in particular a brazed heat exchanger (1) for motor vehicles, has at least one header tank (2) having two junction pieces (3, 4), a binocular-shaped flange (7) for the fastening of pipes and being inserted into the junction pieces (3, 4) which are arranged adjacently at a spacing a with respect to one another. The flange (7) can be produced from plastic and is formed in two parts, so that it is divided essentially in a plane T which is arranged between, preferably at half the spacing "a" between, the junction pieces (3, 4).

5 Claims, 2 Drawing Sheets

U.S. PATENT DOCUMENTS 5,209,440 A * 5/1993 Walker ..... 248/68.1
5,234,185 A * 8/1993 Hoffman et al. ..... 248/56
5,294,156 A 3/1994 Kumazaki et al.
5,332,268 A * 7/1994 Godeau et al. ..... 285/26
5,354,101 A * 10/1994 Anderson, Jr. ..... 285/25
5,370,176 A * 12/1994 Nishishita et al. ..... 165/81
5,377,939 A * 1/1995 Kirma ..... 248/68.1
5,464,256 A * 11/1995 Godeau ..... 285/26
5,477,919 A * 12/1995 Karube ..... 165/176
5,507,529 A * 4/1996 Martins ..... 285/26
5,524,938 A 6/1996 Halder
5,556,137 A * 9/1996 Ream ..... 285/26
5,556,138 A * 9/1996 Nakajima et al. ..... 285/124.4
5,699,834 A * 12/1997 Hayashi et al. ..... 137/884
5,725,255 A * 3/1998 Hayashi et al. ..... 285/26
5,749,995 A 5/1998 Godeau
5,794,897 A * 8/1998 Jobin et al. ..... 248/74.4
5,836,212 A * 11/1998 Bates ..... 74/502.6
5,853,201 A * 12/1998 Izumi et al. ..... 285/179
5,860,677 A * 1/1999 Martins et al. ..... 285/26
5,896,892 A * 4/1999 Adamson et al. ..... 138/89
5,941,483 A * 8/1999 Baginski ..... 248/68.1
5,992,802 A * 11/1999 Campbell ..... 248/68.1
6,019,397 A * 2/2000 Baudu et al. ..... 285/124.1
6,059,324 A 5/2000 Fricker et al.
6,061,880 A * 5/2000 Senninger ..... 24/339
6,070,659 A * 6/2000 Hosoya ..... 165/178
6,142,537 A * 11/2000 Shimada et al. ..... 285/308
6,170,515 B1 * 1/2001 Peterson et al. ..... 137/271
6,202,741 B1 3/2001 Demuth et al.
6,220,343 B1 * 4/2001 Ichiyanagi ..... 165/153
6,257,325 B1 * 7/2001 Watanabe et al. ..... 165/153
6,302,196 B1 * 10/2001 Haussmann ..... 165/153
6,435,565 B2 * 8/2002 Potts et al. ..... 285/124.1
6,443,223 B2 * 9/2002 Ichiyanagi ..... 165/178
6,523,790 B2 * 2/2003 Sentpali et al. ..... 248/68.1
6,547,284 B2 * 4/2003 Rose et al. ..... 285/1
6,561,466 B1 * 5/2003 Myers et al. ..... 248/74.4
6,581,679 B2 * 6/2003 Fischer et al. ..... 165/174
6,601,639 B2 8/2003 Shibata
6,648,375 B1 * 11/2003 Panek ..... 285/124.1
6,682,100 B2 * 1/2004 Wood et al. ..... 285/26
6,688,331 B2 * 2/2004 Demersseman et al. ..... 137/571
D494,450 S * 8/2004 Schultz et al. ..... D8/356
6,776,421 B2 * 8/2004 Florence et al. ..... 277/602
6,866,300 B2 * 3/2005 Hayes et al. ..... 285/124.2
6,871,878 B2 * 3/2005 Miros ..... 285/124.5
6,896,298 B2 * 5/2005 Walterscheid et al. ..... 285/205
6,926,311 B2 * 8/2005 Chang et al. ..... 285/317
7,222,501 B2 * 5/2007 Cho et al. ..... 62/515
2002/0163187 A1 * 11/2002 Pelfrey et al. ..... 285/124.1
2003/0197369 A1 * 10/2003 Fukano et al. ..... 285/124.3
2004/0036277 A1 2/2004 Inaba et al.
2004/0057778 A1 * 3/2004 Gaffe et al. ..... 403/16
2004/0080155 A1 * 4/2004 Hayes et al. ..... 285/124.2

FOREIGN PATENT DOCUMENTS

DE 42 05 063 A1 8/1992
DE 44 32 562 A1 4/1995
DE 44 03 402 A 8/1995
DE 196 21 282 A1 11/1997
DE 196 48 162 A1 5/1998
DE 694 07 283 T2 7/1998
DE 197 37 704 A1 3/1999
DE 197 40 115 A1 3/1999
DE 197 52 139 A1 5/1999
DE 695 04 718 T2 3/2000
DE 100 03 254 A1 8/2000
DE 103 29 312 A1 1/2004
DE 103 23 583 A1 2/2004
EP 0 734 948 A1 10/1996
GB 2 283 070 A 4/1995
JP 2003-176895 A 6/2003

* cited by examiner

HEAT EXCHANGER SUITABLE FOR VEHICLES

CROSS-REFERENCE TO RELATED PATENT APPLICATIONS

The right of foreign priority is claimed under 35 U.S.C. § 119(a) based on Federal Republic of Germany Application No. 10 2004 028 655.8, filed Jun. 15, 2004, the entire contents of which, including the specification, drawings, claims and abstract, are incorporated herein by reference.

BACKGROUND OF THE INVENTION

The invention relates to a heat exchanger, in particular a brazed heat exchanger suitable for use in motor vehicles, and to a pipe junction element for such heat exchangers.

Heat exchangers, in particular radiators or heaters for motor vehicles, have flowing through them on the primary side a fluid, in particular the motor vehicle engine coolant. Connection to the coolant circuit takes place via junction or connection pieces on the heat exchanger which are connected to pipe junction lines for the coolant. Various pipe junction connections are known, depending on the type of construction of the heat exchanger or of its header tank, on which the junction pieces are located. The commonly assigned DE-A 35 17 488 discloses a heat exchanger with a plastic water tank having junction pieces injection molded onto the tank. Coolant junction pipes are inserted into these junction pieces and are secured via a securing clip, which may be referred to as an insertion fork. Similar pipe junction connections are known from commonly assigned DE-C 197 37 704. Where brazed heat exchangers are concerned, both the water tank and the junction pieces which are brazed into the water tank also consist of metal, preferably of aluminum. The insertion fork connection known for plastic junction pieces is transferred in modified form to metallic junction pieces, as proposed in DE-A 44 03 402, DE-C 196 21 282 or DE-A 197 40 115 or DE-A 197 52 139.

Another form of a pipe junction is known from commonly assigned DE-A 196 48 162, specifically for a brazed heat exchanger with junction pieces brazed into the water tank. The coolant junction pipes are inserted into the junction pieces and sealed off by means of O-rings, axial fixing of the junction pipe in the junction piece located on the heat exchanger side taking place by means of what may be referred to as a holding clip ring which engages over an annular bead on the junction pipe and an annular flange on the junction piece. This type of insertion connection permits rapid mounting, that is to say a rapid junction of the coolant tubes to the heat exchanger in the vehicle. In order further to simplify mounting, it is also known to connect the coolant junction pipes to the heat exchanger via a flange, in which the inflow pipe and return pipe are combined. In this case, the heat exchanger has provided on it a first flange which is connected to a second flange in the vehicle in order to produce the coolant junction. For brazed heat exchangers, it is known to produce the flange as an aluminum part which is brazed to the heat exchanger. This brazing or soldering is relatively costly.

SUMMARY OF THE INVENTION

One object of the present invention is to provide a heat exchanger or a pipe junction element of the type initially mentioned more simply and more cost-effectively in terms of its pipe junction connection.

According to one aspect of the invention, there is provided a heat exchanger suitable for motor vehicles, comprising: at least one header tank having two junction pieces arranged at a predetermined distance from one another, for connecting coolant pipes; and a binocular-shaped flange for fastening pipes to the junction pieces and being inserted into the junction pieces, wherein the flange comprises a plastic material and is formed in two parts, divided essentially along a plane T which is arranged between the junction pieces.

According to another aspect of the invention, there is provided a pipe junction element, comprising: a binocular-shaped flange for fastening of pipes to corresponding fixed connection pieces that are located a predetermined distance from one another, wherein the flange is comprised of a plastic material and is formed in two parts, divided essentially along a plane T which is arranged between the junction pieces.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

According to the invention, the flange is produced from plastic and is formed in two parts. By the chosen material being plastic, the flange can be produced at lower cost. The plastic flange is produced in the form of two injection moldings which are inserted into the metallic junction pieces of the heat exchanger which is preferably designed as a heat exchanger for a motor vehicle. Since the brazed heat exchanger, together with its junction pieces, consists of metal, preferably of aluminum, there would be tolerance problems regarding the junction piece spacing in the case of a one-piece flange consisting, for example, of plastic or else of aluminum or of an aluminum alloy. This problem is solved by dividing the flange into two flange halves having an adjustable spacing. Owing to the two-piece character or the division, the flange can be adapted with its connection pieces to the predetermined spacing of the heat exchanger junction pieces. This results in lower production costs for the heat exchanger, including the heat exchanger flange, the function remaining the same, as compared with the prior art. The vehicle-side counterflange, which is connected to the heat exchanger flange for fastening the coolant junction pipes, can therefore also be produced from plastic, aluminum or an aluminum alloy, thus leading to a further cost reduction in the heating circuit.

Figure 1:
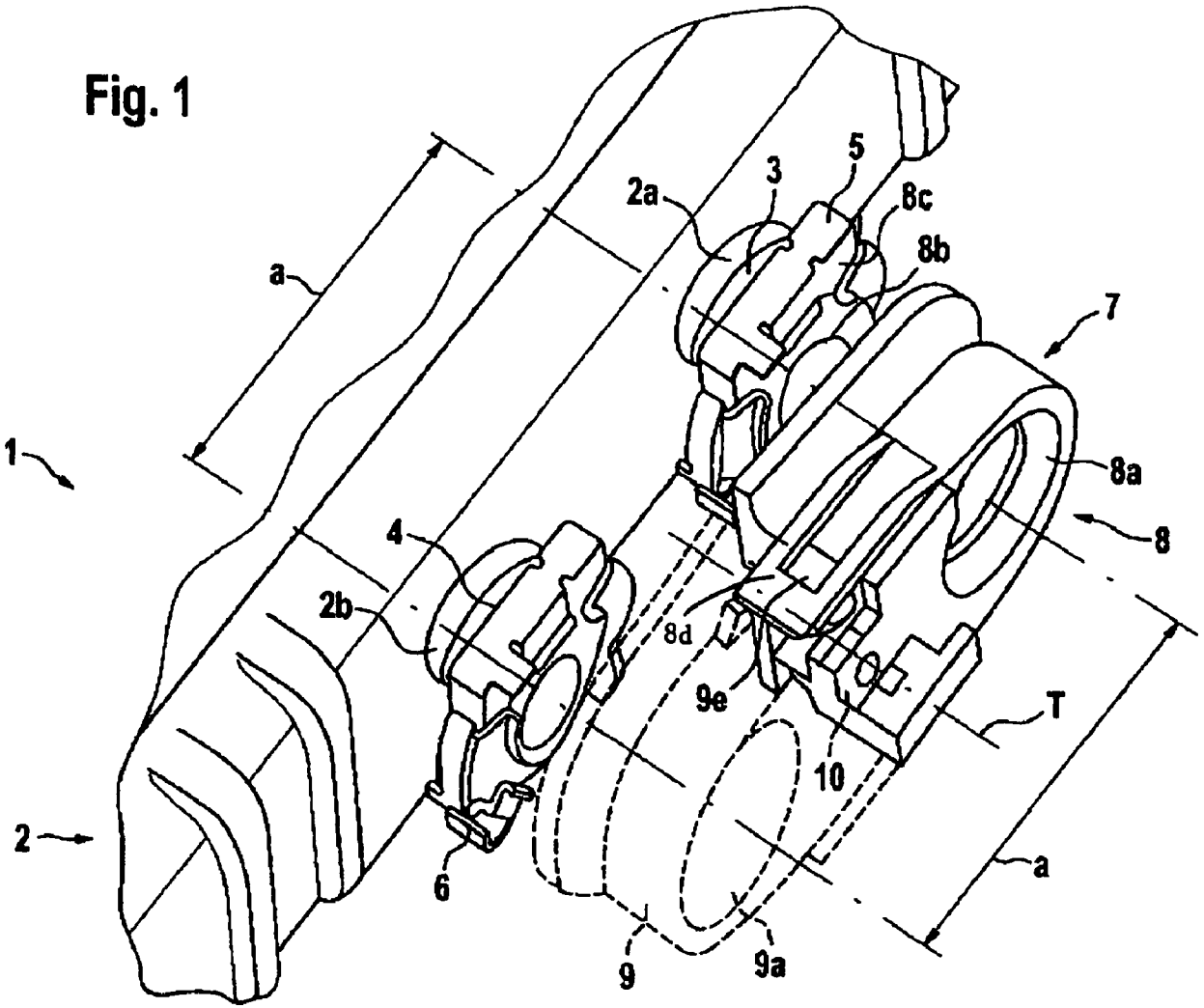
FIG. 1 is a perspective view showing a detail of a heat exchanger with junction pieces and a heat exchanger flange.

FIG. 1 shows a detail of a heat exchanger 1 with a header tank 2, also called a water tank. The heat exchanger 1 is designed as a brazed all-aluminum heat exchanger and is used for the heating of air for a vehicle interior, not illustrated, of a motor vehicle. The water tank 2 has two junction pieces 3, 4 which likewise consist of aluminum and are brazed into corresponding rim holes 2*a*, 2*b* on the water tank 2. A partition, not illustrated, is located between the two junction pieces 3, 4 in the water tank 2 and has the effect of a U-shaped flow through the heat exchanger 1, not illustrated in full (deflection of the coolant "in width"). One of the two junction pieces 3, 4 is therefore the inflow junction piece and the other the return junction piece. The two junction pieces 3, 4 each have an annular flange, not fully viewable here, over which engages in each case a holding clip 5, 6 which is designed as an open ring and is known per se, for example, in a similar form, from the initially mentioned commonly owned DE-A 196 48 162. The two junction pieces 3, 4 have a fixed spacing "a" (from junction piece longitudinal axis to junction piece longitudinal axis). This heat exchanger thus far is of conventional design.

According to the invention, the heat exchanger 1 has connected to it a flange 7 (double flange) made from plastic, which has a spectacle-shaped or binocular-shaped design and consists of two identically designed flange halves 8, 9, the flange half 9 being illustrated only incompletely (by broken lines). The following description of the flange half 8 therefore also applies accordingly to the flange half 9. Each flange half 8, 9 has a passage bore 8*a*, 9*a* which has a spacing "a'" corresponding to the spacing "a", that is to say the passage bores 8*a*, 9*a* are in alignment with the junction pieces 3, 4. The flange half 8 has, on the side facing the water tank 2, a connection piece 8*b* which is inserted in a way not fully viewable into the junction piece 3 of the heat exchanger 1, is sealed off by sealing means, not fully viewable, and is fixed axially by the holding clip 5. For this purpose, there is arranged on the end face of the connection piece 8*b* an annular flange 8*c* (only partially visible), over which parts of the holding clip 5 engage. The flange 7 is thereby connected with its two flange halves 8, 9 to the heat exchanger 1 mechanically and in a fluid-tight, that is to say coolant-tight, manner.

The flange 7 is divided in a dividing plane T which is indicated by a broken line and which runs along a line bisecting the spacing distance "a". The flange half 8 has in its circumferential region a tab 8*d* in the vicinity of the dividing plane T, while the opposite flange half 9 has, in its corresponding circumferential region, a latching hook 9*e* which engages into the tab 8*d* and is latched together with the latter. A corresponding latching connection is provided on the opposite nonvisible side of the two flange halves 8, 9, the tab being provided on the flange half 9 and the latching hook being provided on the flange half 8, that is to say exactly in reverse to the above. The two flange halves 8, 9 are held together by means of this two-sided latching connection. A sheet metal nut 10 is introduced between the two flange halves 8, 9 in the region of the dividing plane T and serves as an abutment for a screw connection to a counterflange, not illustrated. This counterflange receives the ends of coolant junction pipes, not illustrated, and connects these to the heat exchanger-side flange 7. Simple and rapid mounting, that is to say rapid coolant junction, is consequently possible.

As mentioned, the two flange halves 8, 9 are designed as what may be referred to as identical parts and can therefore be produced by means of the same injection molding die. The plastic used is preferably PPA, PA or another plastic.

The heat exchanger flange 7 is mounted by the connection piece 8*b*, and the second connection piece, not illustrated, is inserted into the heat exchanger-side junction pieces 3, 4, with subsequent axial interlocking by means of the holding clips 5, 6. During this mounting operation, the spacing a' of the two flange halves 8, 9 or of their passage bores 8*a*, 9*a* is still somewhat variable, that is to say can be adapted to the spacing a of the heat exchanger-side junction pieces 3, 4. The two latching connections are therefore not yet closed, this taking place only when both connection pieces of the flange halves 8, 9 are received centrically or coaxially by the heat exchanger-side junction pieces. Owing to this variability of the spacing "a'" of the flange 7, tolerance problems between the plastic flange 7 and the aluminum heat exchanger 1 can be ruled out. If the plastic flange 7 were in one piece, that is to say undivided, it would be necessary to reckon on manufacture-related and material-related deviations for the dimensions "a" on the heat exchanger side and "a'" on the flange side, and, if there were no compensating possibility, these deviations would lead to tilting, jamming, stresses and/or leaks. These problems are eliminated by the flange being divided according to the invention.

Figure 2:
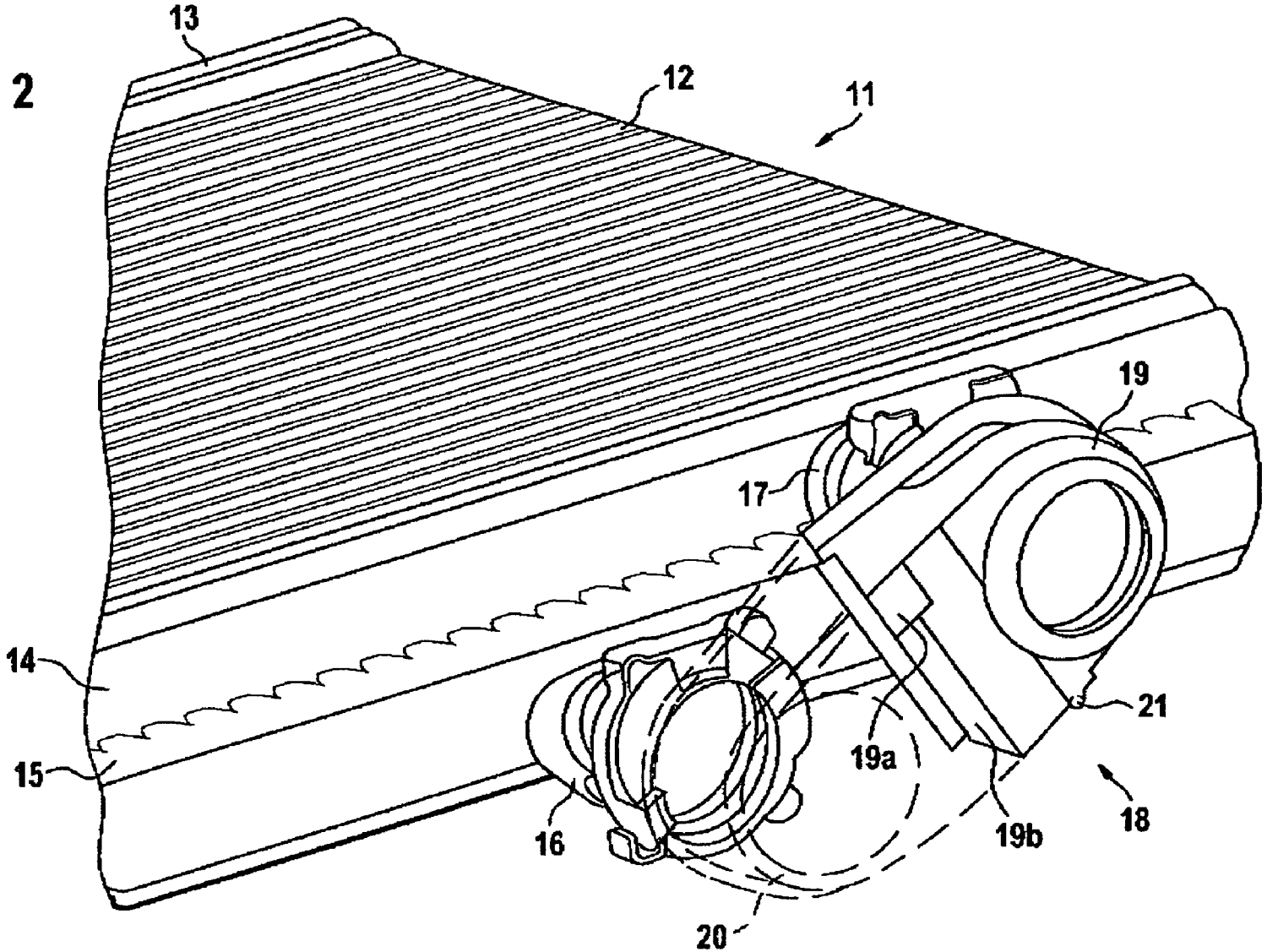
FIG. 2 is a perspective view showing a modified heat exchanger with junction pieces and a heat exchanger flange.

FIG. 2 shows a modified exemplary embodiment of the invention with a heat exchanger 11 consisting of a tube block 12 and of two water tanks 13, 14. In a modification of the previous exemplary embodiment, this heat exchanger 11 has a longitudinal partition 15 in the water tank 14, junction pieces 16, 17 being located on both sides of the longitudinal partition 15. The coolant flowing through the heat exchanger 1 is thus deflected "in depth" or back-to-front, that is to say in or opposite to the flow direction of the air flowing through the block 12. The junction pieces 16, 17 are therefore arranged "obliquely" with respect to one another. In this arrangement, too, a two-part flange 18 made from plastic, for the fastening of coolant junction pipes is provided, which is designed basically identically to the flange 7 according to FIG. 1. The flange, preferably produced from PPA, consists of two flange halves 19, 20 which are likewise held together by means of a latching connection, not described in any more detail here, but of similar design. So that the two flange halves 19, 20 can be joined more effectively, centering means are provided in the region of the dividing plane: the flange half 19 or 20 therefore has a locating pin 19*a* injection-molded on and a locating bore 19*b*, with a locating pin and a locating bore (not illustrated) likewise being provided, offset laterally, on the other flange half 20 (broken lines). The centering means make it easier to mount the two flange halves and make it possible to adapt the spacings "a", "a'" described in relation to the exemplary embodiment according to FIG. 1. A sheet metal nut 21 for screwing to the counterflange, not illustrated, is also introduced into the flange 18.

The foregoing description of preferred embodiments of the invention has been presented for purposes of illustration and description. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto and that the claims encompass the disclosed embodiments and their equivalents.

What is claimed is:

1. A heat exchanger suitable for motor vehicles, comprising:

at least one header tank having two junction pieces arranged at a predetermined distance from one another, wherein the junction pieces are configured to be connected to coolant pipes; and a binocular-shaped flange configured to fasten pipes to the junction pieces, wherein the flange is inserted into the junction pieces, wherein the flange comprises a plastic material and is formed in two parts, divided essentially along a plane arranged between the junction pieces;

wherein the flange comprises two identically shaped flange halves capable of being latched with one another;

wherein the flange halves comprise connection pieces which can be received by the junction pieces;

wherein the connection pieces are fixed in an axial direction by holding elements comprising elastically deformable clip elements.

2. The heat exchanger as claimed in claim 1, wherein the flange halves can be produced as identical injection moldings from a single die.

3. The heat exchanger as claimed in claim 1, wherein the flange comprises polyphthalamide.

4. The heat exchanger as claimed in claim 1, wherein each flange half has a tab circumferentially projecting beyond the dividing plane, and on a diametrically opposite circumferential side a latching hook, and wherein the two flange halves can be latched together via the tab and the latching hook.

5. The heat exchanger as claimed in claim 4, wherein the connection pieces have a spacing with respect to one another which corresponds to the predetermined distance of the junction pieces, wherein the distance of the connection pieces can be fixed by latching the tab and latching hook.

* * * * *